US010961036B2

(12) United States Patent
Belgya

(10) Patent No.: US 10,961,036 B2
(45) Date of Patent: Mar. 30, 2021

(54) SIOC BAG-IN-BOX

(71) Applicant: INTERNATIONAL PAPER COMPANY, Memphis, TN (US)

(72) Inventor: Jason Douglas Belgya, Delaware, OH (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 82 days.

(21) Appl. No.: 15/954,110

(22) Filed: Apr. 16, 2018

(65) Prior Publication Data

US 2020/0255204 A1 Aug. 13, 2020

(51) Int. Cl.

| | |
|---|---|
| ***B65D 77/06*** | (2006.01) |
| ***B65D 5/20*** | (2006.01) |
| ***B65D 5/54*** | (2006.01) |

(52) U.S. Cl.

CPC ..... *B65D 77/065* (2013.01); *B65D 5/2076* (2013.01); *B65D 5/542* (2013.01); *B65D 2571/0066* (2013.01); *B65D 2571/00141* (2013.01)

(58) Field of Classification Search

CPC .... B65D 77/065; B65D 5/2076; B65D 5/542; B65D 5/60; B65D 5/746; B65D 5/40; B65D 5/14; B31B 2120/408

USPC ..... 229/117.31, 117.3, 117.35, 117.27, 121, 229/160.2; 222/105, 81; 220/23.91, 220/495.05, 495.06, 601

See application file for complete search history.

(56) References Cited

U.S. PATENT DOCUMENTS

| | | | | |
|---|---|---|---|---|
| 5,143,278 | A * | 9/1992 | Petriekis | B65D 5/323 229/119 |
| 5,419,485 | A * | 5/1995 | Petriekis | B65D 5/323 229/122.24 |
| 6,168,074 | B1 * | 1/2001 | Petriekis | B65D 5/323 229/122.24 |
| 7,984,845 | B2 * | 7/2011 | Kelly | B65D 5/542 229/242 |
| 10,654,634 | B2 * | 5/2020 | Mabrey | B65D 5/703 |
| 2004/0089672 | A1 * | 5/2004 | Crosland | B65D 5/60 222/105 |
| 2011/0111938 | A1 * | 5/2011 | Smith | B65D 5/4608 493/162 |

(Continued)

FOREIGN PATENT DOCUMENTS

| | | | |
|---|---|---|---|
| EP | 3181479 | A1 | 6/2017 |
| WO | WO-2004089765 | A1 | 10/2004 |

*Primary Examiner* — Christopher R Demeree

(74) *Attorney, Agent, or Firm* — Michael D. Folkerts; Thomas W. Ryan

(57) ABSTRACT

A bag-in-box shipping container including an outer rigid container and an inner flexible container including a dispensing device. Sides of the rigid container are defined by an outer front panel, a first side panel, a back panel, a second side panel, and an inner front panel connected in series at respective first, second, third, and fourth fold lines. A plurality of top flaps are foldably joined to upper edges of the panels to define a top side of the rigid container. A plurality of bottom flaps are foldably joined to lower edges of the panels to define a bottom side of the rigid container. Outer and inner portal covers are formed in the respective outer and inner front panels, and a tear tab is defined by perforated lines adjacent the upper edge of the outer front panel, longitudinally aligned with the outer portal cover.

18 Claims, 6 Drawing Sheets

(56) References Cited

U.S. PATENT DOCUMENTS

2016/0347526 A1* 12/2016 McRae ..... B65D 5/566

* cited by examiner

SIOC BAG-IN-BOX

FIELD OF THE INVENTION

This invention relates generally to bag-in-box containers for fluent materials and, more particularly, to a bag-in-box container that is configured for use as a ships in own container (SIOC) package.

BACKGROUND OF THE INVENTION

It is common practice to contain fluent products, e.g. liquid detergents, in a so-called bag-in-box package rather than, for example, conventional plastic bottles. Such bag-in-box packages can provide particular advantages for shipping bulk quantities of fluent products. Previously identified advantages of bag-in-box packages include more efficient usage of volume, cost reductions over alternative packaging materials, and easier disposal. Further, the shape of bag-in-box packages matches that of conventional shipping containers, such as boxes forming overpacking, such that one or more bag-in-box packages can be efficiently protected within the overpacking. Alternatively, a quantity of bag-in-box packages may be shipped on a pallet. While prior systems for shipping bag-in-box packages have provided an efficient means for shipping bulk supplies of fluent products, shipping of smaller quantities of fluent materials, such as in quantities that may be purchased and used by individual consumers, can be less cost efficient due to redundancy in packaging requirements to ensure that the bag-in-box packaging is protected against damage so as to avoid leakage of the fluent product.

A particular example of challenges associated with shipping products with minimum packaging while maintaining the integrity of the shipping package can be found in c-commerce, where consumer expectations and shipping cost often require that packaging materials and/or packaging size be minimized. Although a typical box of the bag-in-box package can contain and protect the bag during normal consumer handling of the package, such bag-in-box packages generally cannot be shipped under standard package shipping and handling conditions without additional protective wrapping or packaging over the box. For example, known bag-in-box packages often include at least one feature defining a weakened access area on the box to provide easy consumer access to a dispensing device connected to a product bag within the box. Without additional protective wrapping or packaging over the box, the weakened access feature in such known bag-in-box packages may break and compromise the package integrity during standard shipping and handling, that may include impacts, or other forces applied to the package, that can occur as the bag-in-box package moves through e-commerce shipping channels.

SUMMARY OF THE INVENTION

In accordance with an aspect of the invention, a bag-in-box shipping container is provided including an outer rigid container and an inner flexible container including a dispensing device. The shipping container comprises a plurality of panels defining sides of the rigid container, including an outer front panel, a first side panel, a back panel, a second side panel, and an inner front panel connected in series along a longitudinal direction at respective first, second, third, and fourth fold lines. A plurality of top flaps are foldably joined to upper edges of the panels to define a top side of the rigid container. A plurality of bottom flaps are foldably joined to lower edges of the panels to define a bottom side of the rigid container. Outer and inner portal covers are formed in the respective outer and inner front panels, and a tear tab is defined by perforated lines adjacent the upper edge of the outer front panel, longitudinally aligned with the outer portal cover.

The outer front panel may extend over the inner front panel, and portions of the outer front panel adjacent to opposing longitudinal edges of the outer front panel may be adhered to adjacent portions of the inner front panel.

At least a portion of the outer front panel may not be attached to the inner front panel extending from the tear tab to the outer portal cover.

The shipping container may further include a glue tab connected to the outer front panel at a tab fold line opposite from the first fold line, and the glue tab can be adhered to the second side panel.

A tear strip may be provided extending along an inner side of the outer front panel from the tear tab to the outer portal cover.

The outer and inner portal covers may be defined by perforations in the respective outer and inner front panels.

The outer portal cover may be separated from the lower edge of the outer front panel by a continuous section of the outer front panel.

A portion of the outer portal cover may be adhered to an adjacent portion of the inner portal cover.

The adhered portions of the outer and inner portal covers may be detachable from the outer and inner front panels to define an opening for receiving the dispensing device of the inner flexible container.

The top and bottom flaps may comprise major flaps attached the first and second side panels, and minor flaps attached to the back panel and one of the front panels, wherein the minor flaps may be located between respective major flaps at the top and bottom sides of the container.

In accordance with another aspect of the invention, a bag-in-box shipping container is provided including an outer rigid container and an inner flexible container including a dispensing device. The shipping container comprises a plurality of panels defining sides of the rigid container, including an outer front panel, a first side panel, a back panel, a second side panel, and an inner front panel connected in series along a longitudinal direction at respective first, second, third, and fourth fold lines. A plurality of top flaps are foldably joined to upper edges of the panels to define a top side of the rigid container. A plurality of bottom flaps are foldably joined to lower edges of the panels to define a bottom side of the rigid container. Outer and inner portal covers are defined by perforations in the respective outer and inner front panels. A tear tab is defined by perforated lines adjacent the upper edge of the outer front panel, longitudinally aligned with the outer portal cover, and a tear strip defined by a strip of tape extends along an inner side of the outer front panel from the tear tab to the outer portal cover.

A portion of the outer portal cover may be adhered to an adjacent portion of the inner portal cover.

The tear tab and tear strip may be movable to slit the outer front panel from the tear tab to the outer portal cover and to detach the adhered portions of the outer and inner portal covers from the outer and inner front panels to define an opening for receiving the dispensing device of the inner flexible container.

The opening for receiving the dispensing device of the inner flexible container may be separated from the lower edges of the outer and inner front panels by continuous sections of the respective outer and inner front panels.

In accordance with a further aspect of the invention, a one-piece blank of sheet material for forming a bag-in-box shipping container is provided. The blank comprises an outer front panel, a first side panel, a back panel, a second side panel, and an inner front panel connected in series along a longitudinal direction at respective first, second, third, and fourth fold lines. One or more top flaps are foldably joined to an upper edge of one or more of the panels. One or more bottom flaps are foldably joined to a lower edge of one or more of the panels. Outer and inner portal covers are formed in the respective outer and inner front panels, and a tear tab is formed adjacent the upper edge of the outer front panel, longitudinally aligned with the outer portal cover.

A glue tab may be provided connected to the outer front panel at a tab fold line opposite from the first fold line.

A tear strip may be provided extending along an inner side of the outer front panel from the tear tab to the outer portal cover.

The tear tab may be defined by a pair of perforated lines extending into the outer front panel from the upper edge of the outer front panel.

The outer and inner portal covers may be defined by perforations in the respective outer and inner front panels.

The outer portal cover may be separated from the lower edge of the outer front panel by a continuous section of the outer front panel.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

The present description is directed to a container construction commonly known as a bag-in-box container. The container described herein can facilitate compact shipping and storage of the container prior to use, by providing a collapsed configuration until the container is needed for containment and shipping of a fluent product. The described container can comprise an outer rigid container surrounding an inner flexible container including a dispensing device. The outer rigid container can be formed from a blank processed either with equipment designed for this purpose or by hand. For example, the blank may be folded using equipment similar to currently available case forming machines, or the container can be formed through manually implemented steps, or through a combination of machine implemented and manual steps. Further, the outer rigid container is provided with a configuration that can meet standards for shipping without requiring overpacking, including aspects that facilitate container strength, as may be understood further from the following detailed description.

Figure 1:
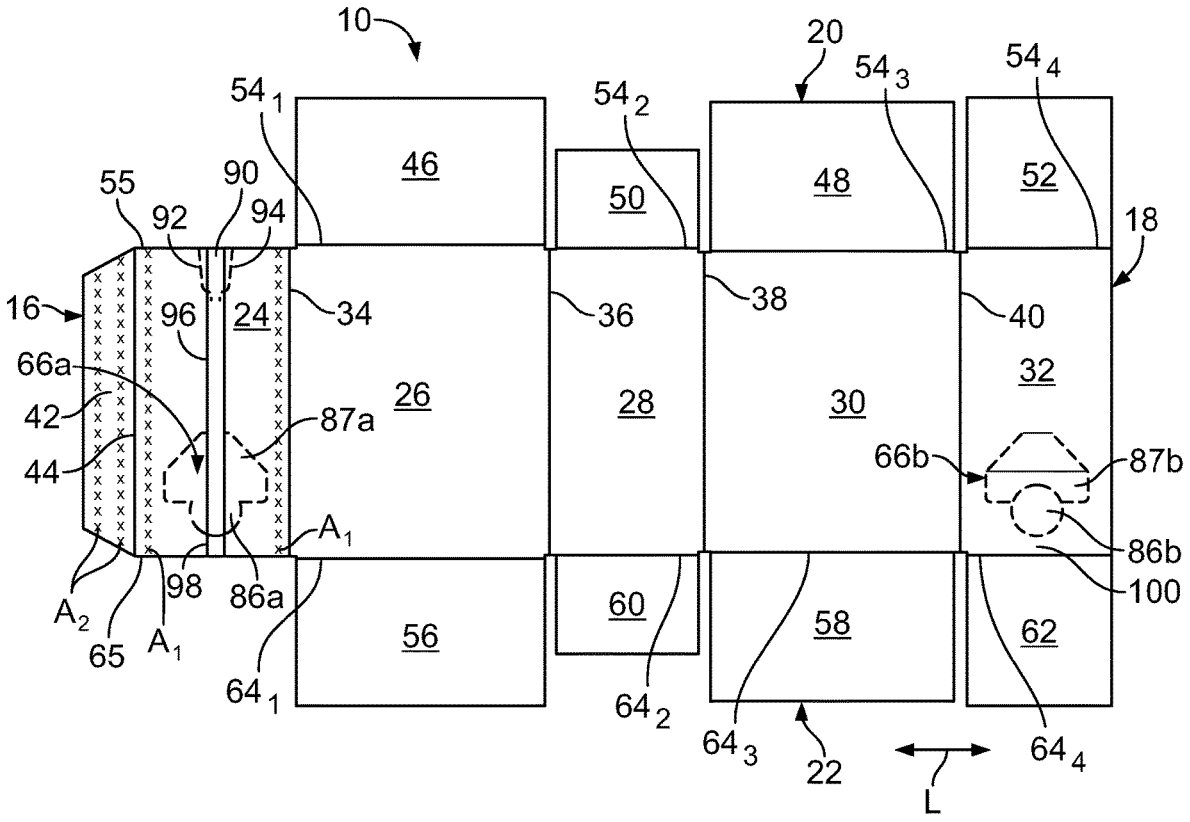
FIG. 1 is a plan view of a blank for forming a rigid container.
Figure 8:
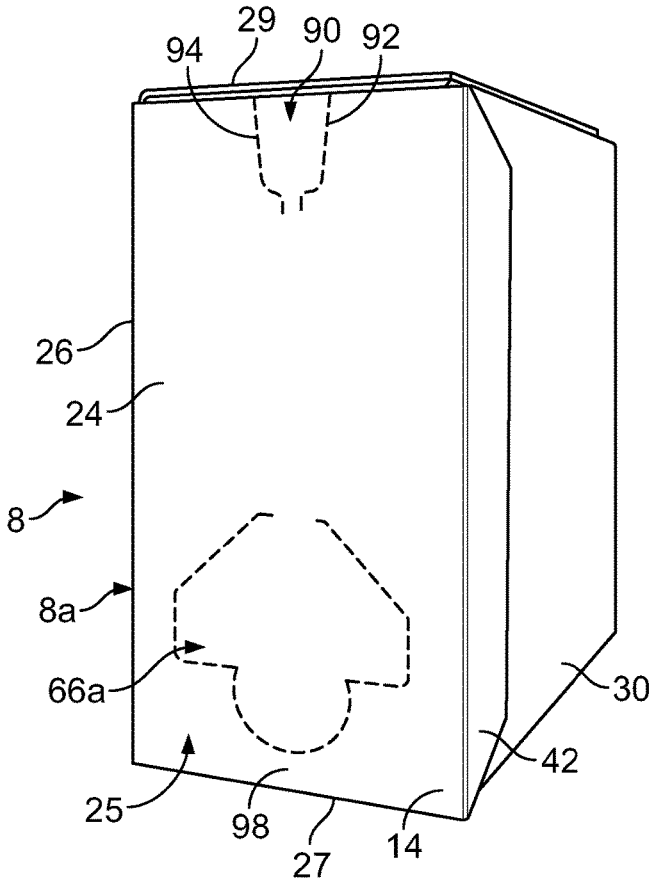
FIG. 8 is a perspective view of the completed bag-in-box container.

Referring to FIG. 1, a die cut blank 10 is shown for illustrating one or more aspects of the container described herein. In a use of the blank 10 to form a one-piece outer rigid container 8*a*, see FIG. 8, the blank 10 may be formed of single-wall corrugated cardboard material and may be die cut to the shape shown herein, although other materials and variations of the illustrated shape may be provided within the scope of the container described herein. The blank 10 illustrated in FIG. 1 is a planar piece of material in which an inner side 12 is shown facing out of the page and an outer side 14, see FIG. 8, is facing an opposite direction from the inner side 12. That is, for the single-wall corrugated material of the blank 10, the inner side 12 can be defined by the inner liner on one side of a fluted layer material, and the outer side 14 can be defined by the outer liner on the opposite side of the fluted layer of material.

As seen in FIG. 1, the blank 10 extends in a longitudinal direction L between first and second longitudinal ends, generally designated 16 and 18, respectively, and further extends in a lateral direction between first and second lateral edges, generally designated 20 and 22, respectively. The blank 10 comprises a plurality of panels defining sides of the rigid container 8*a*, including an outer front panel 24, a first side panel 26, a back panel 28, a second side panel 30, and an inner front panel 32 connected in series. The outer front panel 24 is connected to the first side panel 26 at a first lateral fold line 34, the first side panel 26 is connected to the back panel 28 at a second lateral fold line 36, the back panel 28 is connected to the second side panel 30 at a third lateral fold line 38, and the second side panel 30 is connected to the inner front panel 32 at a fourth lateral fold line 40. A longitudinal length of the outer front panel 24, extending in the longitudinal direction L, is substantially equal to a longitudinal length of the back panel 28, and substantially equal to the longitudinal length of the inner front panel 32. In an embodiment of the blank 10, the longitudinal length of the outer front panel 24 may be slightly longer, e.g., ⅛ in.

longer or less, than the longitudinal length of the back panel 28 and/or the inner front panel 32.

A blank 10 can further include a glue tab 42 connected to the outer front panel 24 at a tab fold line 44 opposite from the first fold line 34. A longitudinal edge of the glue tab 42 opposite from the tab fold line 44 can define the first longitudinal edge 16 of the blank 10. It may be understood that the glue tab 42 can define an additional or sixth panel, i.e., in addition to the outer front panel 24, first side panel 26, back panel 28, second side panel 30, and inner front panel 32, such that the blank 10 can be used to form a six panel box or container, as described in the container forming steps below.

First and second major top flaps 46, 48 are foldably joined to upper edges of the respective first and second side panels 26, 30 along respective upper score lines 541, 543. First and second minor top flaps 50, 52 are foldably joined to upper edges of the back panel 28 and inner front panel 32 along respective upper score lines 542, 544. It may be noted that the upper score lines 541, 542, 543, 544 may be located at slightly different levels to accommodate positioning of the top flaps 46, 48, 50, 52 during a folding operation.

First and second major bottom flaps 56, 58 are foldably joined to lower edges of the respective first and second side panels 26, 30 along respective lower score lines 641, 643. First and second minor bottom flaps 60, 62 are foldably joined to lower edges of the back panel 28 and inner front panel 32 along respective lower score lines 642, 644. It may be noted that the lower score lines 641, 642, 643, 644 may be located at slightly different levels to accommodate positioning of the bottom flaps 56, 58, 60, 62 during a folding operation.

Figure 2A:
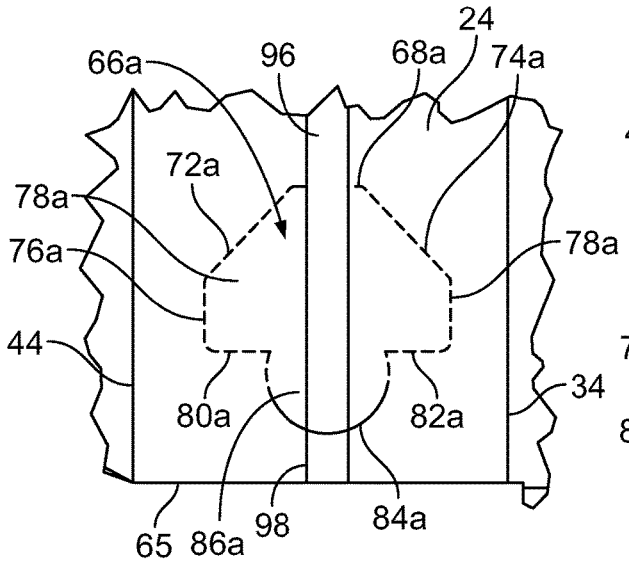
FIG. 2A is an enlarged detail view of an outer portal cover formed in an outer front panel of the container.

An outer portal cover 66*a* is formed in the longitudinal center of the outer front panel 24, as defined by perforations, e.g., through perforations in the outer front panel 24. Referring to FIG. 2A, the outer portal cover 66*a* is formed with an irregular shape comprising an upper edge 68*a*, a pair of sloped edges 72*a*, 74*a* extending downwardly from the upper edge 68*a*, a pair of vertical edges 76*a*, 78*a* extending downwardly from the sloped edges 72*a*, 74*a*, a pair of bottom edges 80*a*, 82*a* extending horizontally inwardly from the vertical edges 76*a*, 78*a*, and a generally semicircular edge 84*a* extending between the bottom edges 80*a*, 82*a*. The generally semicircular edge 84*a* defines a lower generally semicircular portal cover segment 86*a* that may be continuous with the remainder 87*a* of the outer portal cover 66*a* located above the bottom edges 80*a*, 82*a*.

It should be noted that "perforation," as used herein, can include intermittent or continuous cuts extending fully or partially through the material described as containing the perforation. Further, it should be understood that the upper edge 68*a* is preferably an imaginary line that connects the upper ends of the sloped lines 72*a*, 74*a*, and comprises a line extending across a solid (non-perforated) section of the outer front panel 24.

Figure 2B:
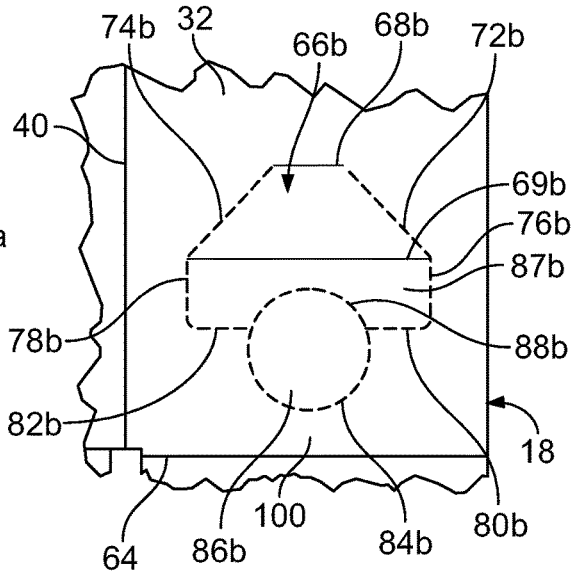
FIG. 2B is an enlarged detail view of an inner portal cover formed in an inner front panel of the container.

Referring to FIG. 2B, an inner portal cover 66*b* is formed in the longitudinal center of the inner front panel 32, as defined by perforations, e.g., through perforations in the inner front panel 32, and is vertically aligned with the outer portal cover 66*a* on the outer front panel 24. The inner portal cover 66*b* is formed with an irregular shape corresponding to the shape of the outer portal cover 66*a*. The inner portal cover 66*b* includes an upper edge 68*b*, a pair of sloped edges 72*b*, 74*b* extending downwardly from the upper edge 68*b*, a pair of vertical edges 76*b*, 78*b* extending downwardly from the sloped edges 72*b*, 74*b*, a pair of bottom edges 80*b*, 82*b* extending horizontally inwardly from the vertical edges 76*b*, 78*b*, and a lower generally semicircular edge 84*b* extending between the bottom edges 80*b*, 82*b*. A circular removable portal cover segment 86*b* is defined by the perforation forming the lower generally semicircular edge 84*b* and by an upper generally semicircular edge 88*b* which is defined by a perforation, e.g., a cut through the material of the blank 10.

Referring to FIG. 1, a tear tab 90 is defined by perforations comprising, e.g., a pair of cut lines 92, 94 extending through the material of the blank 10 adjacent to the upper edge 55 of the outer front panel 24, longitudinally aligned with the outer portal cover 66*a*, i.e., centered on the outer front panel 24. Further, a tear strip 96 extends from the upper edge 55 to the lower edge 65 of the outer front panel 24. In particular the tear strip 96 is adhered to the inner side 12 of the blank 10 and extends at least from a location on the tear tab 90 to a location on the outer portal cover 66*a*. The tear strip 96 can be a tear tape formed of a narrow ribbon of polymeric material that is adhesively attached to the inner side 12 and may be, for example, an approximately ½ inch to ¾ inch wide ribbon of polymeric material.

Referring to FIGS. 1, 2A, and 2B, it should be noted that the outer front panel 24 includes an area 98 of continuous material between the lower edge 65 and the generally semicircular edge 84*a*. That is, the area 98 of the outer front panel 24 extending from the lower edge 65 to the vertical location of the generally semicircular edge 84*a*, and extending laterally between the first fold line 34 and the glue tab fold line 44, is formed without perforations, holes or cut outs to facilitate maintaining structural strength in the area 98. Similarly, the inner front panel 32 includes an area 100 of continuous material between the lower common fold line 64 and the generally semicircular edge 84*b*. That is, the area 100 of the inner front panel 32 extending from the lower common fold line 64 to the vertical location of the generally semicircular edge 84*b*, and extending laterally between the fourth fold line 40 and the second longitudinal edge 18, is formed without perforations, holes or cut outs to facilitate maintaining structural strength in the area 100.

As used herein "continuous" refers to material of the panels that does not include features that form a break or separation in the material, such as may typically be formed by perforations, holes, cut outs, or similar features. In accordance with particular aspects of the present description, the portal covers 66*a*, 66*b* are each surrounded with continuous material such that no perforations, holes or cut outs extend from the edges of the outer and inner front panels 24, 32 to the portal covers 66*a*, 66*b*.

Referring to FIGS. 3-9, a series of folding steps using the blank 10 of FIG. 1 is described for forming a shipping container 8, see FIG. 8. Although the preferred embodiments presented herein describe applying an "adhesive" forming a joint between adjacent flaps and panels, or forming a "joint adhering" adjacent flaps and panels, it should be understood that such a joint or connection between the flaps and panels can be formed by gluing or can be equivalently formed through other attachment mechanisms for connecting the flaps and panels together, and may alternatively encompass, without limitation, gluing, taping, stapling or stitching.

Figure 3:
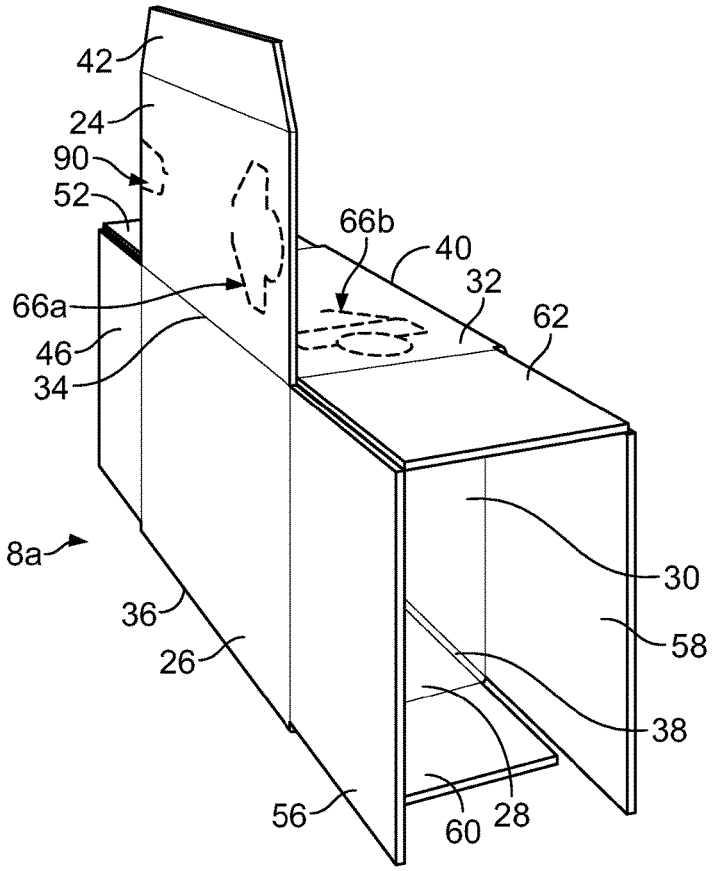
FIG. 3 is a perspective view illustrating initial steps for folding front, side, and back panels forming the container.
Figure 4:
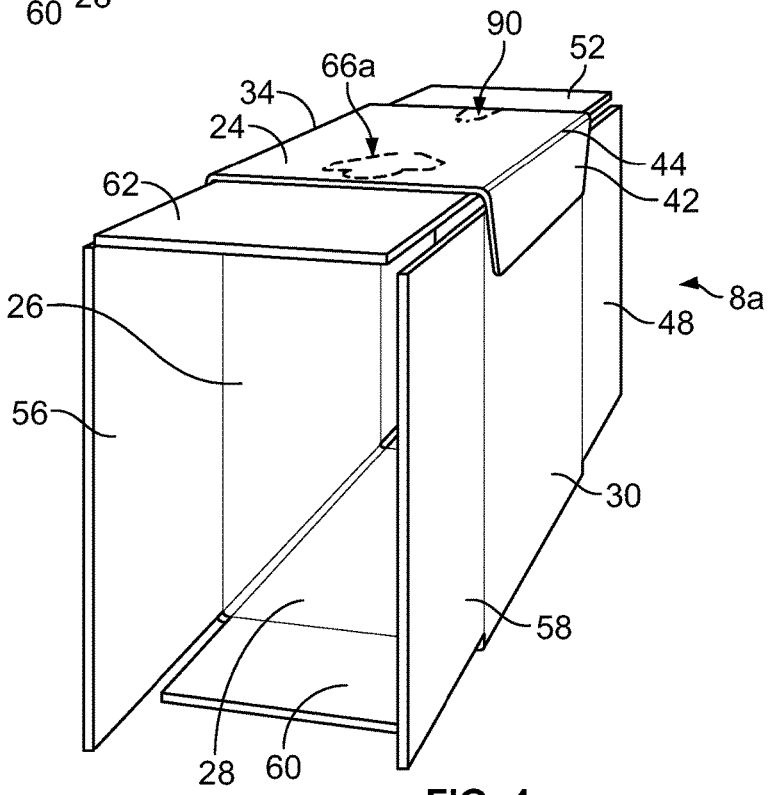
FIG. 4 is a perspective view illustrating steps for completing folding of the front, side, and back panels forming the container.

As illustrated in FIG. 3, the first side panel 26 and second side panel 30 are folded about the respective second and third fold lines 36, 38 upward or perpendicular to the back panel 28. The inner front panel 32 is folded about the fourth fold line 40 to extend perpendicular to the second side panel 30 and locate the second longitudinal edge 18 adjacent to the first fold line 34. Subsequently, the outer front panel 24 is folded about the first fold line 34 to position the outer front panel 24 in overlapping relation to the inner front panel 32, and the glue tab 42 is folded about the tab fold line 44 to position the glue tab 42 in overlapping relation with the second side panel 30, wherein the outer portal cover 66*a* is located in overlapping relation to the inner portal cover 66*b*. Adhesive may be applied between the overlapping outer and inner front panels 24, 32 to form a joint adhering the outer and inner front panels 24, 32 together to form a double layer front wall 25 for the rigid container 8*a*, see FIG. 8. For example, at least two adhesive strips $A_1$, e.g., glue strips, may be applied to the inner surface 12 of the outer front panel 24 adjacent to the tab fold line 44 and adjacent to the first fold line 34, see FIG. 1. Additional adhesive (not shown) may also be applied between the circular removable portal cover segment 86*b* and the outer portal cover 66*a* to form a joint adhering the circular removable portal cover segment 86*b* and the outer portal cover 66*a* together. Also, a pair of adhesive strips $A_2$, e.g., glue strips, may be applied to the inner surface 12 of the glue tab 42 to form a joint adhering the glue tab 42 to the second side panel 30.

In accordance with the embodiment described herein, the two adhesive strips $A_1$ are located laterally outward from the portal covers 66*a*, 66*b*, wherein the remaining area of the outer front panel 24 between the two adhesive strips $A_1$, and extending from the tear tab 90 to the outer portal cover 66*a*, does not include adhesive so as to avoid adhesive joints that could interfere with user implemented steps for opening the rigid container 8*a*, as will be described further below. It should be understood that the glue tab 42 attached to the second side panel 30, and the associated 90 degree junction formed at the tab fold line 44, provides increased rigidity to the front wall 25. That is, although the outer and inner front panels 24, 32 are not adhered to each other across the full face of the panels 24, 32, additional panel strength to resist distortion, such as buckling, of the front wall 25 is provided via the glue tab 42.

Figure 5:
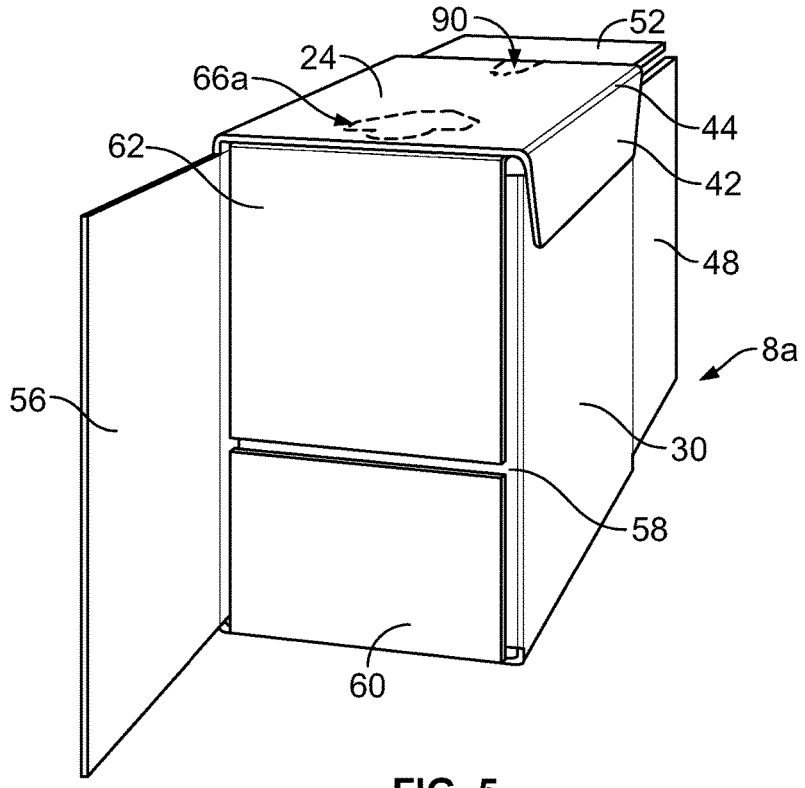
FIG. 5 is a perspective view illustrating folding bottom flaps of the container.

Referring to FIG. 5, the bottom side 27 (FIG. 6) of the rigid container 8*a* is formed by initially folding the second major bottom flap 58 perpendicular to the second side panel 30, and folding the first and second minor bottom flaps 60, 62 into overlapping relation over the second major bottom flap 58. Subsequently, formation of the bottom side 27 of the rigid container 8*a* is completed by folding the first major bottom flap 56 over the minor bottom flaps 60, 62. The bottom flaps 56, 58, 60, 62 forming the bottom side 27 can be joined by adhesive joints, such as an adhesive joint between the second major bottom flap 58 and the minor bottom flaps 60, 62 and an adhesive joint between the first major bottom flap 56 and the minor bottom flaps 60, 62. The folding sequence for the flaps 56, 58, 60, 62 forming the bottom side 27 is provided such that an inner surface of the second major bottom flap 58 defines a continuous smooth surface for contact with a flexible container 8*b* located within the rigid container 8*a*, see FIG. 6. Hence, the interior of the rigid container 8*a* at the bottom side 27 avoids panel edges that could abrade and/or puncture the flexible container 8*b*.

Figure 6:
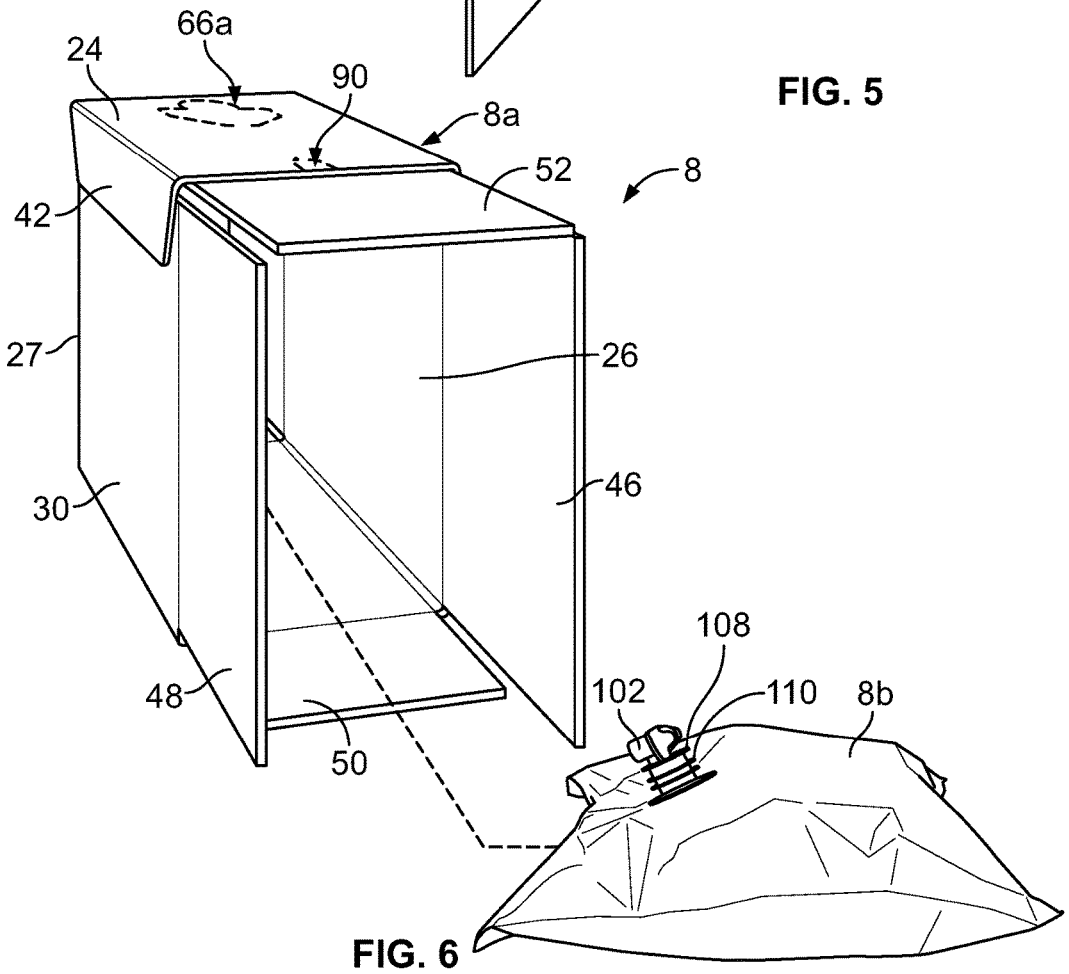
FIG. 6 is a perspective view illustrating assembly of a flexible container into the rigid container to form a bag-in-box container.
Figure 7:
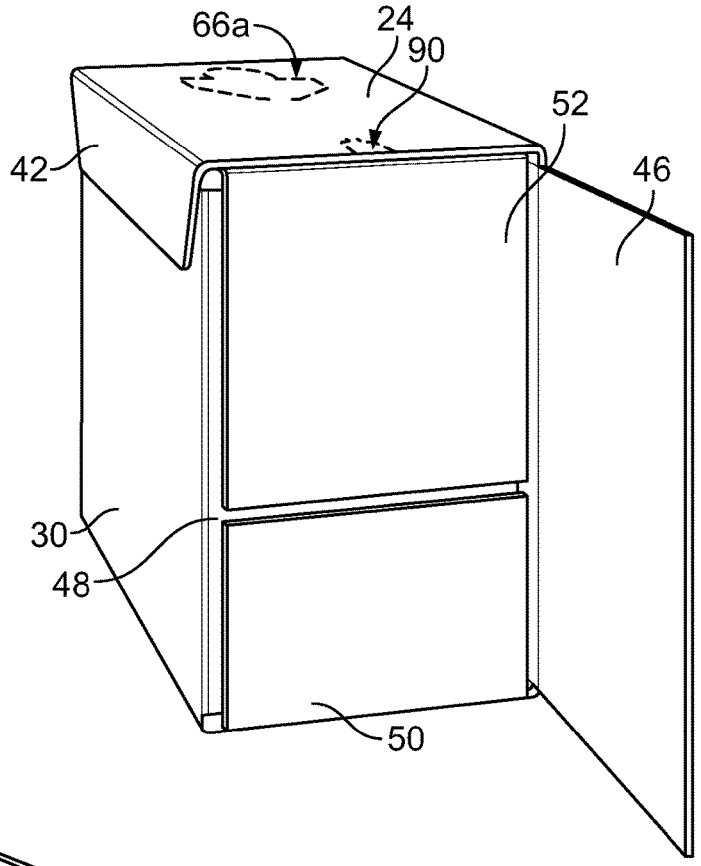
FIG. 7 is a perspective view illustrating folding top flaps of the container.

Referring to FIG. 6, the bag-in-box shipping container 8 is formed by inserting the flexible container 8*b* into the open top end of the rigid container 8*a*. The flexible container 8*b* may comprise a bag formed of a flexible material, e.g., a plastic or film material, that is impermeable to a fluent product contained within the flexible container 8*b*. The flexible container 8*b* includes a dispensing device 102 or spout comprising a valve for controllably dispensing a fluent product contained within the flexible container 8*b*. The flexible container 8*b* can be filled to a predetermined level with the fluent product prior to placement of the flexible container 8*b* into the rigid container 8*a*. During placement of the flexible container 8*b* into the rigid container 8*a*, the dispensing device 102 is positioned toward the front wall 25 of the rigid container 8*a*, and is located adjacent to the portal covers 66*a*, 66*b*.

Following placement of the flexible container 8*b* into the rigid container 8*a*, the top flaps 46, 48, 50, 52 can be folded in the same sequence of steps as described above for the bottom flaps 56, 58, 60, 62. Specifically, referring to FIG. 7, the top side 29 (FIG. 8) of the rigid container 8*a* is formed by initially folding the second major top flap 48 perpendicular to the second side panel 30, and folding the first and second minor top flaps 50, 52 into overlapping relation over the second major top flap 48. Subsequently, formation of the top side 29 of the rigid container 8*a* is completed by folding the first major top flap 46 over the minor top flaps 50, 52. The top flaps 46, 48, 50, 52 forming the top side 29 can be joined by adhesive joints, such as an adhesive joint between the second major top flap 48 and the minor top flaps 50, 52 and an adhesive joint between the first major top flap 46 and the minor top flaps 50, 52. The folding sequence for the flaps 46, 48, 50, 52 forming the top side 29 is provided such that an inner surface of the second major top flap 48 defines a continuous smooth surface for contact with the flexible container 8*b* located within the rigid container 8*a*, see FIG. 6. Hence, the interior of the rigid container 8*a* at the top side 29 avoids panel edges that could abrade and/or puncture the flexible container 86*b*. Folding of the top flaps 46, 48, 50, 52 results in the flexible container 86*b* being fully enclosed within the rigid container 8*a* to complete formation of the bag-in-box shipping container 8, see FIG. 8.

It should be understood that the folding steps for forming the rigid container 8*a* may be performed in an order that is different from the folding steps described above. Further, placement of the flexible container 8*b* into the rigid container may be performed by inserting the flexible container 8*b* into an open bottom end of the rigid container 8*a* subsequent to folding of the top flaps 46, 48, 50, 52, followed by folding of the bottom flaps 56, 58, 60, 62 to fully enclose the flexible container 8*b* within the rigid container 8*a*.

Figure 9:
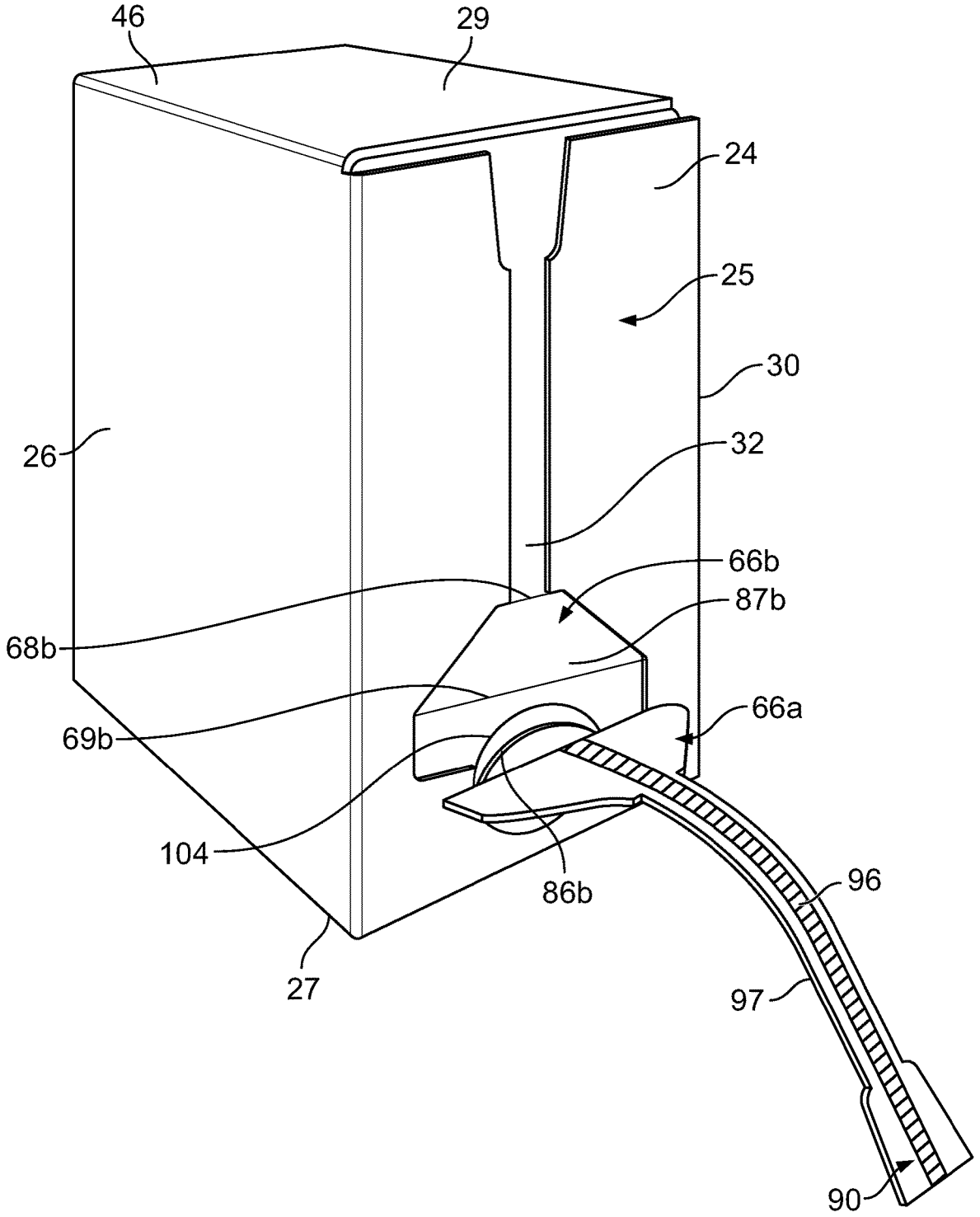
FIG. 9 is a perspective view illustrating outward movement of a tear tab and tear strip to open the container for use in a dispensing a fluent product.
Figure 10:
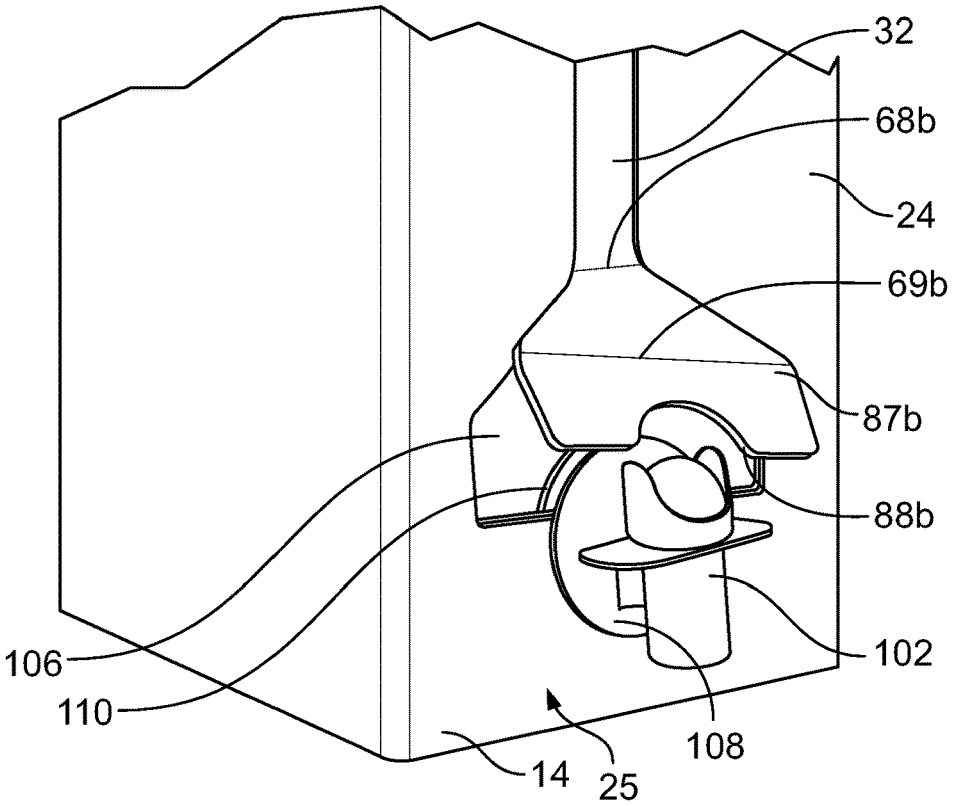
FIG. 10 is a perspective view of a lower portion of the container illustrating pivoting an inner portal cover outwardly to position a spout through a spout access opening.
Figure 11:
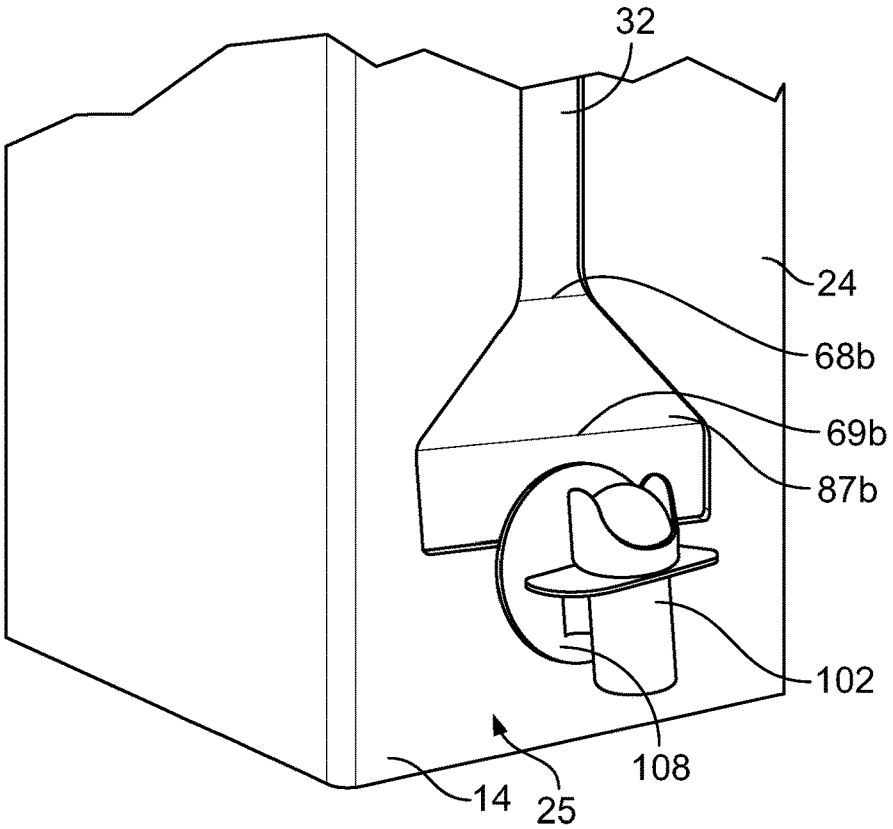
FIG. 11 is a perspective view of a lower portion of the container illustrating positioning the inner portal cover to a spout mounting position behind a flange of the spout.

Referring to FIGS. 9-11, a process for opening the container 8 is described, such as to prepare the container 8 for dispensing a fluent product from the spout 102 at a point of use. FIG. 9 illustrates a step of pulling down on the tear tab 90 and attached tear strip 96 to tear a strip of material 97 from the outer front panel 24 of the rigid container 8*a*. When the strip of torn material reaches the outer portal cover 66*a*, the tear strip 96 forms a tear across the upper edge 68*a* and the outer portal cover 66*a* separates from the outer front panel 24 along the perforated lines 72*a*, 74*a*, 76*a*, 78*a*, 80*a*, 82*a*, 84*a*. Also, the removable portal cover segment 86*b*, attached to the outer portal cover 66*a*, is separated from the inner front panel 32 as the outer portal cover 66*a* is pulled outwardly to define a circular spout portal or opening 104 in the front wall 25. It should be understood that by forming the upper edge 68*a* as a solid section of material, the strength of the outer front panel 24 is maintained at the connection between the outer portal cover 66*a* and the outer front panel 24, while the tear strip 96 provides an effective means for a user to readily separate the portal cover 66*a* from the outer front panel 24, i.e., to tear the material across the upper edge 68*a*, in order to prepare for dispensing the fluent product. It should also be understood that the semicircular edge 84*a* is preferably formed by a continuous through cut below the bottom edges 80*a*, 82*a* to facilitate separation of the outer portal cover 66*a* from the outer front panel 24 without affecting the integrity of the continuous material area 98, i.e., without tearing the continuous material area 98.

After the outer portal cover 66*a* is separated from the outer front wall 24, the remaining upper portion 87*b* of the inner portal cover 66*b* is pivoted outwardly about the upper edge 68*b* to separate the perforated lines 72*b*, 74*b*, 76*a*, 78*b*, 80*b*, 82*b* from the inner front panel 32 and define an enlarged spout access portal or opening 106, see FIG. 10. It should be noted that the upper edge 68*b* is preferably not perforated and defines a fold line location about which the upper portion 87*b* can pivot. A user can reach the spout 102 through the spout access opening 106 to position the spout 102 on the lower edge of the spout opening 104, as is illustrated in FIG. 10. The spout 102 can include a flange 108 that is positioned in front of the outer surface 14 of the outer front panel 24, and can further include a rib 110, see FIG. 6, that is positioned against the inner surface of the inner front panel 32. Subsequent to positioning the spout 102 in the spout opening 104, the upper portion 87*b* of the inner portal cover 66*b* is pivoted inwardly and positioned behind the flange 108, as seen in FIG. 11. It may be noted that the upper portion 87*b* of the portal cover 66*b* preferably includes a score line 69*b* to form a bendable lower section of the upper portion 87*b*, wherein the lower section of the upper portion 87*b* can be bent about the score line 69*b* to facilitate placement of the upper portion 87*b* behind the flange 108. Hence, the generally semicircular edge 88*b* is positioned surrounding an upper portion of the spout 102 to retain the spout 102 in position within the spout opening 104.

From the above description, it may be understood that the rigid container 8*a* does not include any holes or cutouts to form the spout access opening 106. Further, a tear strip 96 is provided to form the spout opening 104 by displacing the outer portal cover 66*a* and removable portal cover segment 86*b*, wherein the spout opening 104 provides a hole that facilitates gripping and pivoting the inner portal cover 66*b* outwardly for formation of the spout access opening 106. Hence, a continuous solid layer of material, i.e., without perforations, holes or cutouts, surrounds each of the outer and inner portal covers 66*a*, 66*b* and forms a solid double thickness front wall 25 for structural strength during shipping, and the tear strip 96 provides ready access to form the spout opening 104 at the point of use. The structural strength of the front wall 25 is further enhanced by the glue tab 42 folded perpendicular to the front wall 25 and affixed to the second side wall 30 to resist distortion of the front wall 25, such as may result from forces applied to the container 8, e.g., forces resulting from dropping the container 8 during shipping.

It should also be noted that the container 8 described herein may be relatively small, e.g., a container sized to hold approximately 140 oz. of a fluent product such as laundry detergent or softener, that can be shipped directly to an individual consumer as an end user. However, the container 8 is not limited to a particular size and the container 8 may be smaller or larger than the container described herein.

By providing the above-described bag-in-box container 8 with aspects facilitating the strength and/or durability of the outer rigid container 8*a*, the present bag-in-box container 8 is serviceable as a ships in own container (SIOC) bag-in-box package. That is, the container 8 provides a continuous solid surface around the portal covers 66*a*, 66*b* in the front wall 25 and provides a strengthening glue tab 42 adjacent to the front wall 25 to resist distortion of the front wall 25. Accordingly, the perforated features 66*a*, 66*b*, forming part of the system for providing convenient consumer access to the dispensing device 102, will remain intact during impacts, or other rough handling, that could occur during shipping of the container 8, e.g., during transport though typical e-commerce shipping channels.

Further, the rigid container 8*a* and flexible container 8*b* can facilitate compact shipping and storage of the container components prior to use, by providing a collapsed configuration until the container 8 is needed for containment and shipping of a fluent product. Hence, a system is described for providing a container 8 for fluent product that can reduce the volume or space requirement for storing the container components prior to filling with the fluent product, and that can reduce shipping costs, e.g., via reduced material cost and smaller package size, as a result of not requiring overpacking for shipping the filled container 8.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A bag-in-box shipping container including an outer rigid container and an inner flexible container including a dispensing device, the shipping container comprising:

a plurality of panels defining sides of the rigid container, including an outer front panel, a first side panel, a back panel, a second side panel, and an inner front panel connected in series along a longitudinal direction at respective first, second, third, and fourth fold lines;

a plurality of top flaps foldably joined to upper edges of the panels to define a top side of the rigid container;

a plurality of bottom flaps foldably joined to lower edges of the panels to define a bottom side of the rigid container;

outer and inner portal covers formed in the respective outer and inner front panels, wherein the outer and inner portal covers are each defined by perforations in the respective outer and inner front panels; and a tear tab defined by perforated lines adjacent the upper edge of the outer front panel, longitudinally aligned with the outer portal cover.

2. The shipping container as set forth in claim 1, wherein the outer front panel extends over the inner front panel, and portions of the outer front panel adjacent to opposing longitudinal edges of the outer front panel are adhered to adjacent portions of the inner front panel.

3. The shipping container as set forth in claim 2, wherein at least a portion of the outer front panel is not attached to the inner front panel extending from the tear tab to the outer portal cover.

4. The shipping container as set forth in claim 2, further including a glue tab connected to the outer front panel at a tab fold line opposite from the first fold line, the glue tab adhered to the second side panel.

5. The blank as set forth in claim 1, including a tear strip extending along an inner side of the outer front panel from the tear tab to the outer portal cover.

6. The blank as set forth in claim 1, wherein the outer portal cover is separated from the lower edge of the outer front panel by a continuous section of the outer front panel.

7. The shipping container as set forth in claim 1, wherein a portion of the outer portal cover is adhered to an adjacent portion of the inner portal cover.

8. The shipping container as set forth in claim 7, wherein the adhered portions of the outer and inner portal covers are detachable from the outer and inner front panels to define an opening for receiving the dispensing device of the inner flexible container.

9. The shipping container as set forth in claim 1, wherein the top and bottom flaps comprise major flaps attached the first and second side panels, and minor flaps attached to the back panel and one of the front panels, wherein the minor flaps are located between respective major flaps at the top and bottom sides of the container.

10. A bag-in-box shipping container including an outer rigid container and an inner flexible container including a dispensing device, the shipping container comprising:

a plurality of panels defining sides of the rigid container, including an outer front panel, a first side panel, a back panel, a second side panel, and an inner front panel connected in series along a longitudinal direction at respective first, second, third, and fourth fold lines;

a plurality of top flaps foldably joined to upper edges of the panels to define a top side of the rigid container;

a plurality of bottom flaps foldably joined to lower edges of the panels to define a bottom side of the rigid container;

outer and inner portal covers, wherein each of the outer and inner portal covers are defined by perforations in the respective outer and inner front panels;

a tear tab defined by perforated lines adjacent the upper edge of the outer front panel, longitudinally aligned with the outer portal cover; and a tear strip defined by a strip of tape extending along an inner side of the outer front panel from the tear tab to the outer portal cover.

11. The shipping container as set forth in claim 10, wherein a portion of the outer portal cover is adhered to an adjacent portion of the inner portal cover.

12. The shipping container as set forth in claim 11, wherein the tear tab and tear strip are movable to slit the outer front panel from the tear tab to the outer portal cover and to detach the adhered portions of the outer and inner portal covers from the outer and inner front panels to define an opening for receiving the dispensing device of the inner flexible container.

13. The blank as set forth in claim 12, wherein the opening for receiving the dispensing device of the inner flexible container is separated from the lower edges of the outer and inner front panels by continuous sections of the respective outer and inner front panels.

14. A one-piece blank of sheet material for forming a bag-in-box shipping container, the blank comprising:

an outer front panel, a first side panel, a back panel, a second side panel, and an inner front panel connected in series along a longitudinal direction at respective first, second, third, and fourth fold lines;

one or more top flaps foldably joined to an upper edge of one or more of the panels;

one or more bottom flaps foldably joined to a lower edge of one or more of the panels;

outer and inner portal covers formed in the respective outer and inner front panels, wherein the outer and inner portal covers are each defined by perforations in the respective outer and inner front panels; and a tear tab formed adjacent the upper edge of the outer front panel, longitudinally aligned with the outer portal cover.

15. The blank as set forth in claim 14, further including a glue tab connected to the outer front panel at a tab fold line opposite from the first fold line.

16. The blank as set forth in claim 14, including a tear strip extending along an inner side of the outer front panel from the tear tab to the outer portal cover.

17. The blank as set forth in claim 14, wherein the tear tab is defined by a pair of perforated lines extending into the outer front panel from the upper edge of the outer front panel.

18. The blank as set forth in claim 14, wherein the outer portal cover is separated from the lower edge of the outer front panel by a continuous section of the outer front panel.

* * * * *